US005615726A

United States Patent [19]

Ota et al.

[11] Patent Number: 5,615,726

[45] Date of Patent: Apr. 1, 1997

[54] CASTING MOLD

[75] Inventors: Atsushi Ota, Toyota; Seizi Uda, Okazaki; Shingo Nakamura, Toyota; Hidehiko Kadono, Toyota, all of Japan

[73] Assignee: Toyota Jidosha Kabushiki Kaisha, Aichi-ken, Japan

[21] Appl. No.: 578,487

[22] Filed: Dec. 26, 1995

Related U.S. Application Data

[62] Division of Ser. No. 295,031, Aug. 25, 1994, abandoned.

[30] Foreign Application Priority Data

Aug. 27, 1993 [JP] Japan ..... 5-213128

[51] Int. Cl.[6] ..... B22C 9/10; B22D 19/00; B22D 29/00

[52] U.S. Cl. ..... 164/32; 164/369; 164/98; 164/132

[58] Field of Search ..... 164/32, 132, 529, 164/6, 369, 340, 98

[56] References Cited

U.S. PATENT DOCUMENTS

| | | |
|---|---|---|
| 1,396,341 | 11/1921 | Rautenbach . |
| 4,890,543 | 1/1990 | Kudou et al. . |
| 5,251,683 | 10/1993 | Backer . |

FOREIGN PATENT DOCUMENTS

| | | |
|---|---|---|
| 1076338 | 10/1954 | France . |
| 2108852 | 5/1972 | France . |
| 973984 | 9/1954 | Germany . |
| U-59-25361 | of 1984 | Japan . |
| A-63-144845 | 6/1988 | Japan . |
| 63-144845 | 6/1988 | Japan . |
| 63-281760 | 11/1988 | Japan . |
| A-2-84230 | 3/1990 | Japan . |
| 2193914 | 2/1988 | United Kingdom . |
| 2248203 | 4/1992 | United Kingdom ..... 164/132 |

OTHER PUBLICATIONS

Abstract of Japanese Patent Application No. 2,084,230, Mar. 26, 1990; Derwent Publication Ltd., London, GB; AN 90136013.

*Primary Examiner*—Joseph J. Hail, III
*Assistant Examiner*—I.-H. Lin
*Attorney, Agent, or Firm*—Oliff & Berridge

[57] ABSTRACT

A casting mold includes a cavity formed therein, and an auxiliary mold projecting into the cavity. The auxiliary mold forms a concave portion in a cast product, and it exhibits a thermal expansion coefficient being more than a thermal expansion coefficient exhibited by a molten metal to be charged into the cavity. Hence, the auxiliary mold greatly expands thermally during casting, and it keeps the expanded state during the solidification of the molten metal. Accordingly, the casting mold can prevent the casting defects resulting from the shrinkage cavities from arising in the resulting cast products. All in all, the casting mold can obviate to give the auxiliary mold a tapered configuration, and it can reduce the after-casting machining allowance to be provided in the resulting concave portion.

13 Claims, 2 Drawing Sheets

( PRIOR ART )

CASTING MOLD

This is a division of application Ser. No. 08/295,031 filed Aug. 25, 1994, and now abandoned.

BACKGROUND OF THE INVENTION

1. Field of the Invention

The present invention relates to a casting mold which is used to produce a cast product having a concave portion, e.g., a hole or the like, therein. It particularly relates to a construction of the casting mold.

2. Description of the Related Art

For instance, as set forth in Japanese Unexamined Utility Model Publication (KOKAI) No. 59-25,361, a core or a core pin has been used conventionally when producing a cast product which has a concave portion such as a hole or the like therein. The core or the core pin is subjected to a holding force which results from the shrinkage of a molten metal during solidification. Accordingly, it is difficult to remove the core or the core pin from the resulting cast product after cooling the cast product. Hence, in order to make the core or the core pin likely to be removed from the cast product, it is usually tapered gradually from wide to narrow in the direction toward its leading end.

When the cast products are produced by using the core or the core pin, they come to have a concave portion such as a hole or the like. However, the resulting concave portion is inevitably formed in a tapered hole whose inside diameter reduces from large to small in the direction toward its inner side. Thus, it is hard to make the resulting concave portion which has an identical inside diameter over its entire length. As a result, it is a routine practice to carry out machining on the inner periphery of the concave portion after the casting, thereby establishing an identical inside diameter over the entire length of the concave portion.

In particular, when die-casting aluminum or zinc, the molten aluminum or zinc is solidified rapidly at its surface where it is brought into contact with a mold. Consequently, at the surface where the molten aluminum or zinc is brought into contact with the mold, there is formed a healthy layer in which no bubbles are involved in a thickness of from about 0.7 to 1.0 mm. However, there exist blow holes in the deeper layer disposed under the healthy layer, because the molten aluminum or zinc is solidified at a slower rate in the deeper layer.

Thus, when the taper-holed concave portion formed by casting is machined, and especially when the concave portion has a long overall length, the machining allowance should be enlarged on the inner side of the concave portion so that it goes beyond the healthy layer. As a result, the blow holes come to be exposed to produce defects. For example, when a cast product is produced by using a core or a core pin having a draft angle of 1 degree and when the resulting concave portion has an overall length of 200 mm, the concave portion should be machined in excess of about 3.49 mm at its innermost portion. Accordingly, the concave portion is machined completely beyond the healthy layer. However, in view of the removability of the core or the core pin from the cast product, it is actually impossible to get rid of the draft taper, and accordingly it is inevitable to carry out the machining after the casting. Hence, there always exists the fear for machining the cast product beyond the healthy layer.

A casting process using a cast insert member has been known, in which casting is carried out after a cast insert member e.g., a liner or the like, formed independently is disposed in a cavity. In this process, there exists a fear for deforming a cast insert member, because a cylindrical liner, for instance, is deformed by the shrinkage force of a molten metal during solidification. Accordingly, casting is carried out after disposing a protective member in a cast insert member. If such is the case, there should be provided a clearance between the cast insert member and the protective member. Consequently, it is difficult to completely get rid of the deformation in the cast insert member. Further, in order to prevent the protective member from being stuck in the cast insert member due to the deformation in the cast insert member, the protective member should be formed in a configuration having a draft taper. Consequently, when the east insert member is deformed to conform to the configuration of the protective member, it is required to machine the inner periphery of the cast insert member after casting, and at the same time, there occur problems in that the machining has resulted in the partially fluctuating thickness in the cast insert member. Furthermore, there are produced defects which result from the molten metal invasion into the clearance between the cast insert member and the protective member.

SUMMARY OF THE INVENTION

The present invention is developed in view of the aforementioned circumstances. It is therefore an object of the present invention to give a concave portion formed by casting an inside diameter as identical as possible over its entire length, and to reduce a machining allowance after casting.

A casting mold according to the present invention can solve the problems described above, and it comprises:

a cavity formed therein; and an auxiliary mold projecting into the cavity, forming a concave portion in a cast product, and exhibiting a thermal expansion coefficient being equivalent to or more than a thermal expansion coefficient exhibited by a molten metal to be charged into the cavity.

A preferred form of the present casting mold can also solve the above-described problems, and at the same time it can inhibit the defects associated with the deformation of the conventional cast insert members from arising. In the preferred form thereof, the auxiliary mold further includes a casting insert member disposed around its outer periphery.

In the present casting mold, the auxiliary mold greatly expands thermally during casting. While it keeps the expanded state, the molten metal starts solidifying. Accordingly, the molten metal is subjected to a pressing force resulting from the expansion of the auxiliary mold during its solidification process. With the present casting mold, it is possible to inhibit the defects like the shrinkage cavities and so on from producing in the resulting cast products.

Further, when cooling the resulting cast products, the auxiliary mold shrinks more than the molten metal adjacent thereto does. Consequently, there arises a clearance between the outer peripheral surface of the auxiliary mold and the inner peripheral surface of the concave portion formed by the auxiliary mold in the resulting casting products. As a result, even when the untapered configuration is given to the auxiliary mold, it is possible to remove the auxiliary mold from the concave portion with ease and to reduce the machining allowance in the concave portion which has been usually required after casting.

Furthermore, when the auxiliary mold includes the cast insert member disposed on its outer periphery as done in the preferred form of the present casting mold, casting is carried out while the auxiliary mold is fitted into the cast insert member. Accordingly, the auxiliary mold expands greatly, thereby outwardly pressing the inner peripheral surface of the cast insert member. As a result, it is possible to reduce the clearance between the cast insert member and the auxiliary mold to zero. Hence, it is possible to inhibit the cast insert member from being deformed by the shrinkage stress of the molten metal and to prohibit the molten metal from invading between the cast insert member and the auxiliary mold.

Moreover, when cooling the resulting cast products, the auxiliary mold shrinks considerably to thereby produce a clearance between itself and the cast insert member. Consequently, it is possible to remove the auxiliary mold from the cast insert member with ease. Therefore, it is unnecessary to give the conventional tapered configuration to the auxiliary mold. Thus, it is possible to get rid of the step of machining the cast insert member after casting.

As having been described so far, in accordance with the present casting mold, it is possible to sharply reduce the man-hour requirements required for the machining step after the casting step. Further, it is possible to inhibit the blow holes from exposing and to prohibit the casting material from being wasted, and thereby it is possible to reduce the production cost.

In particular, even when the cast insert member is employed, the cast insert member is inhibited from being deformed by the shrinkage force of the molten metal. Accordingly, it is possible to get rid of the step of machining the cast insert member after the casting and to prevent the strength of the cast insert member from being deteriorated.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Preferred Embodiment

Figure 1:
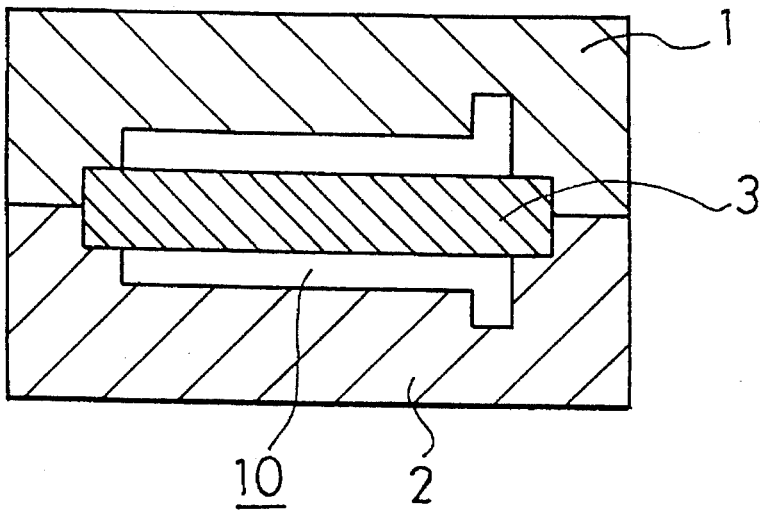
FIG. 1 is a schematic cross-sectional view of a casting mold of a First Preferred Embodiment according to the present invention.

In FIG. 1, there is illustrated a schematic cross-sectional view of a casting mold of a First Preferred Embodiment according to the present invention. The casting mold comprises a pair of main molds 1, 2, a cavity 10 formed by the main molds 1, 2, and a cylindrical slider pin 3 disposed in the cavity 10. The casting mold is used for casting an aluminum die-cast component part. The slider pin 3 is formed of a high-manganese-content alloy which includes Mn in an amount of 22% by weight.

Figure 2:
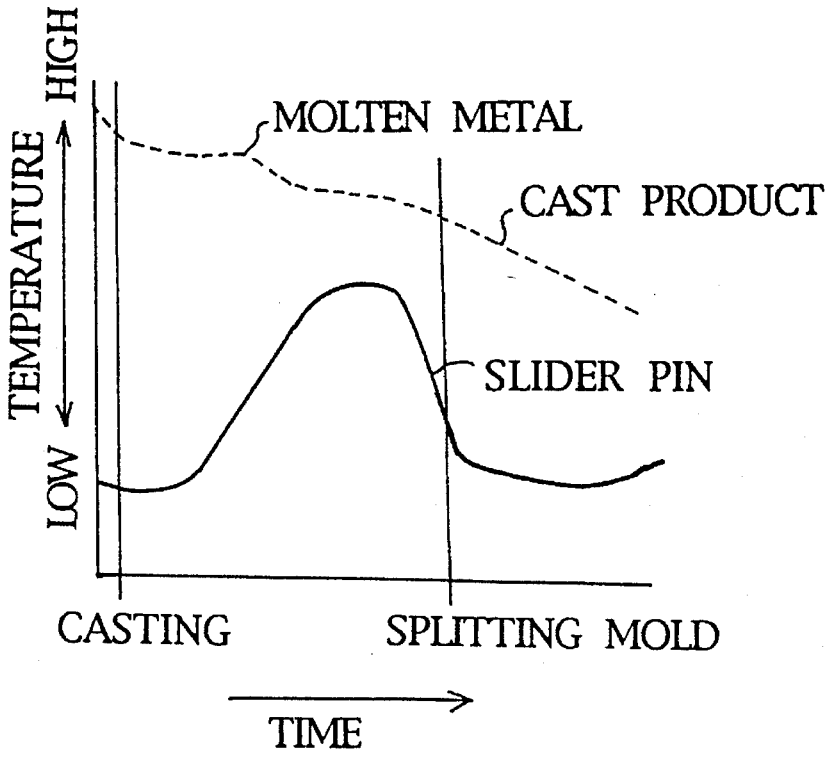
FIG. 2 is a graph illustrating the relationship between the temperature and the time during casting in which the casting mold of the First Preferred Embodiment is employed.

Casting was carried out by charging a molten aluminum alloy into the casting mold constructed as described above. In FIG. 2, there are illustrated a variation of the temperature of the molten aluminum alloy (or a cast product) with the time elapsed and a variation of the temperature of the slider pin 3 therewith. During the casting, the temperature of the molten aluminum alloy decreased gradually, but the temperature of the slider pin 3 increased sharply so as to approach the temperature of the molten aluminum alloy. Since the slider pin 3 exhibited a thermal expansion coefficient greater than that of the molten aluminum alloy, the slider pin 3 expanded to apply a pressing force to the molten aluminum alloy.

Immediately after or before the solidification of the molten aluminum alloy was completed, water was supplied to a cooling water circuit (not shown) provided in the casting mold in order to cool itself and the cast product. Thus, the slider pin 3 was cooled rapidly. However, there exhibited a thermal resistance at the interface between the slider pin 3 and the cast product, and accordingly there was produced a large temperature difference between the slider pin 3 and the cast product. As a result, the slider pin 3 shrunk greatly, and it produced a large clearance between itself and the cast product. Hence, the slider pin 3 could be removed from the east product with ease.

Figure 4:
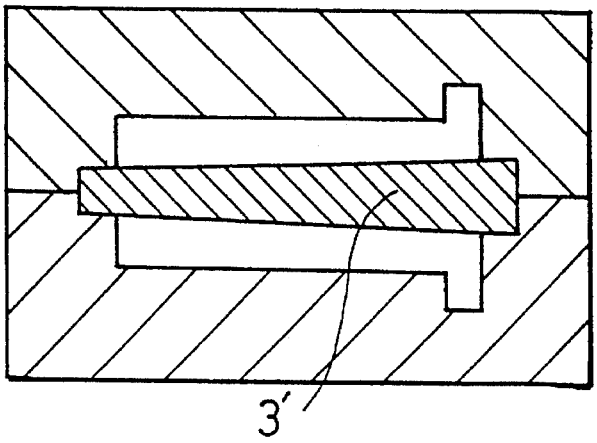
FIG. 4 is a schematic cross-sectional view of a conventional casting mold.

In FIG. 4, there is illustrated a casting mold which has been used conventionally. In the conventional casting mold, a slider pin 3' was employed which had a maximum diameter of 30 mm. Since it was formed of a steel, it exhibited a thermal expansion coefficient smaller than that of the molten aluminum alloy. When the solidification of the molten aluminum alloy was completed and when the conventional casting mold was about; to be split, the cast product shrunk more than the slider pin 3' did, thereby fastening the slider pin 3'. Hence, the slider pin 3' was provided with a draft angle of 1 degree in order to make it likely to be removed from the east product. Consequently, after the casting, the hole portion thus formed should be machined on the inner periphery by 2.24 mm at maximum, thereby producing the defects resulting from the shrinkage cavities. In addition, there arose the material loss which resulted in the problem in conjunction with the manufacturing cost.

On the other hand, in the casting mold of the First Preferred Embodiment, the slider pin 3 could be removed from the cast product with ease even when it had a maximum diameter of 30 mm and it was provided with a draft angle of 15 minutes. If such was the case, it was necessary to machine the inner periphery of the hole portion only by a machining allowance of 0.8 mm at maximum after the casting. Therefore, it was possible to inhibit the material from being wasted, and at the same time there was produced no defect resulting from the shrinkage cavities.

For instance, the slider pin 3 for casting an aluminum die-cast component part can be made from either a high-manganese-content alloy which includes Mn in an amount of from 10 to 25% by weight, C in an amount of from 0.2 to 1.5% by weight, Cr in an amount of from 1 to 3% by weight, and the balance of Fe and inevitable impurities, an austenite stainless steel, or a bimetallic alloy which includes Mn in an amount of from 65 to 80% by weight, Cr in an amount of from 10 to 20% by weight, and the balance of Ni and inevitable impurities.

Second Preferred Embodiment

Figure 3:
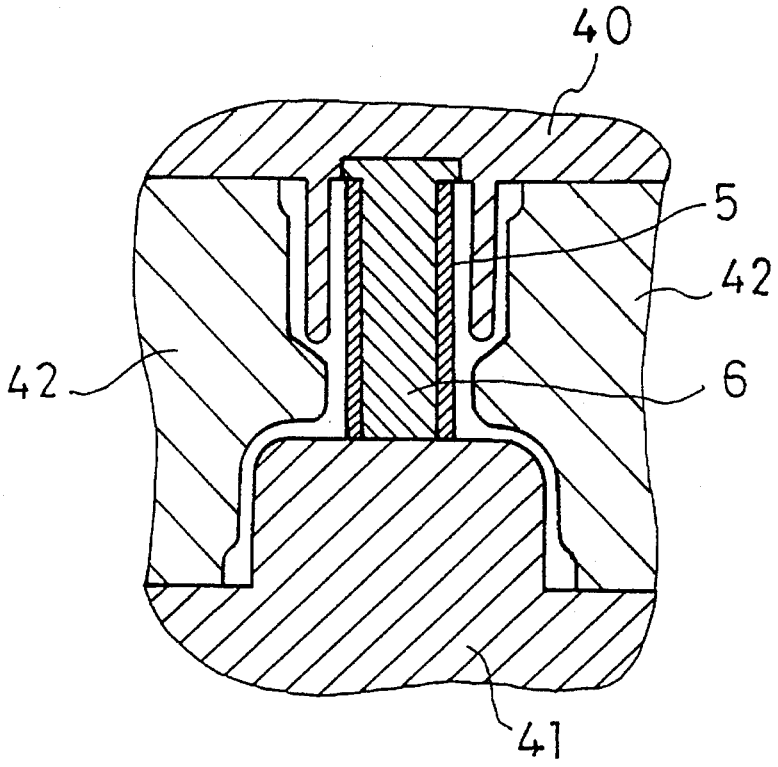
FIG. 3 is a schematic cross-sectional view of a casting mold of a Second Preferred Embodiment according to the present invention.

In FIG. 3, there is illustrated a schematic cross-sectional view of a casting mold of a Second Preferred Embodiment according to the present invention. The casting mold is designed to cast an automotive engine block, one of the aluminum die-cast component parts. It comprises an upper mold 40, a lower mold 41, and a pair of slider cores 42, 42. Between the upper mold 40 and the lower mold 41, there is disposed a liner 5 (i.e., the cast insert member) for constituting an inner peripheral surface of a bore. Moreover, an auxiliary mold 6 is held by the upper mold 40 at one of the opposite ends, and it is fitted into the liner 5.

The liner 5 is made from a steel. The auxiliary mold 6 is formed of a bimetallic alloy which includes Mn in an amount of 68% by weight, and accordingly it exhibits a thermal expansion coefficient remarkably larger than those of the liner 5 and the resulting cast product. Moreover, when cooled, the auxiliary mold 6 is designed so that it has an outside diameter slightly smaller than the inside diameter of the liner 5.

When the casting mold of the Second Preferred Embodiment was cooled, and when the auxiliary mold 6 was fitted into the liner 5, there was produced a clearance between the liner 5 and the auxiliary mold 6 so that the auxiliary mold 6 could be easily fitted into the liner 5.

Then, when charging a molten aluminum alloy into the casting mold of the Second Preferred Embodiment, the liner 5 and the auxiliary mold 6 were expanded by the heat of the molten aluminum alloy. Since the auxiliary mold 6 exhibited a thermal expansion coefficient remarkably larger than that of the liner 5, it contacted with the inner periphery of the liner 5 to press the liner 5 in the expanding direction. Thus, the clearance disappeared, and accordingly the molten aluminum alloy barely invaded the intersurface between the liner 5 and the auxiliary mold 6. Moreover, the expanding stress arisen in the liner 5 was conveyed to press the molten aluminum alloy. In this pressed state, the molten aluminum alloy solidified. As a result, the casting defects resulting from the shrinkage cavities or the like could be inhibited from occurring.

When the molten aluminum alloy started solidifying, the liner 5 was subjected to the shrinkage force arisen in the cast product. At this moment, however, the auxiliary mold 6 was still in the expanding state, and it still contacted with the inner peripheral surface of the liner 5. Consequently, the liner 5 was hardly deformed, and thereby it could be integrated with the cast product. When the casting mold was cooled, the auxiliary mold 6 shrunk greatly to produce a clearance between itself and the liner 5. Thus, the auxiliary mold 6 could be removed from the liner 5 with ease.

All in all, in the resulting cast product, the liner 5 could maintain the predetermined configuration, and it did not require the finish machining. Thus, it was possible to give the liner 5 an as-designed thickness. Accordingly, the liner 5 could exhibit its maximum mechanical strength.

In addition, in the casting mold of the Second Preferred Embodiment, it is preferable to preliminarily heat the liner 5 and the auxiliary mold 6 to about 200° C. before charging the molten aluminum alloy into the casting mold. If the preliminary heating is done, the clearance between the liner 5 and the auxiliary mold 6 has disappeared before starting the charging of the molten aluminum alloy thereinto. Hence, it is possible to further reliably inhibit the invasion of the molten aluminum alloy into the clearance as well as the deformation of the liner 5 due to the pressure associated with the charging.

Having now fully described the present invention, it will be apparent to one of ordinary skill in the art that many changes and modifications can be made thereto without departing from the spirit or scope of the present invention as set forth herein including the appended claims.

What is claimed is:

1. A method of molding, comprising:

providing a cavity in a casting mold;

projecting an auxiliary mold having a thermal expansion coefficient that is greater than a thermal expansion coefficient of a molten metal to be charged into said cavity for forming a concave portion in a cast article;

charging said molten metal into said cavity; and forcibly cooling said auxiliary mold before and after said molten metal has completely solidified for contracting said auxiliary mold so as to form a clearance between said auxiliary mold and said solidified molten metal.

2. The method of claim 1, further comprising the step of forming said auxiliary mold from a high manganese content alloy.

3. The method of molding according to claim 2, wherein said step of forming said auxiliary mold from a high manganese content alloy includes providing Mn in an amount of from 10%–25% by weight, C in an amount from 0.20%–1.50% by weight, Cr in an amount of from 1.0%–3.0% by weight, and the balance of Fe and inevitable impurities.

4. The method of molding according to claim 1, further comprising the step of forming said auxiliary mold from an austenitic stainless steel.

5. The method according to claim 1, further comprising the step of forming said auxiliary mold from a bimetallic alloy.

6. The method of molding according to claim 5, wherein said step of forming said auxiliary mold from a bimetallic alloy includes providing Mn in an amount from 65.00%–80.00% by weight, Cr in an amount from 10.00%–20.00% by weight, and the balance of Ni and inevitable impurities.

7. The method of molding according to claim 1, further comprising the step of contacting an untapered portion of the auxiliary mold with the molten metal.

8. The method of molding according to claim 1, wherein said step of charging a molten metal includes charging aluminum or an aluminum alloy.

9. The method of molding according to claim 1, wherein said step of charging a molten metal includes charging zinc or a zinc alloy.

10. A method of molding, comprising:

providing a casting mold having a cavity formed therein, a liner sized and adapted to be disposed within said cavity and having a liner thermal expansion coefficient and an auxiliary mold sized and adapted to be movable within said liner in a sliding, close-fitting relationship and having an auxiliary mold thermal expansion coefficient greater than said liner thermal expansion coefficient; and charging a molten metal into said cavity thereby causing thermal expansion of said liner and said auxiliary mold whereby said auxiliary mold thermally expands within and against said liner from the sliding, close-fitting relationship and into an immobile, contacting relationship thereby pressing said liner in an expanding direction toward said molten metal.

11. A method according to claim 10, further comprising the step, after the charging step, of cooling said molten metal to cause solidification thereof thereby first causing a reduction in thermal expansion of said liner in a reduction direction being opposite of said expanding direction before causing a reduction in thermal expansion of said auxiliary mold.

12. A method according to claim 11, further comprising the step, after the molten metal cooling step, of cooling said auxiliary mold until a sufficient amount of reduction in thermal expansion of said auxiliary mold changes the immobile, contacting relationship between said auxiliary mold and said liner to the sliding, close-fitting relationship.

13. A method of molding, comprising:

providing a casting mold having a cavity formed therein, a cast insert sized and adapted to be disposed within said cavity and having a cast insert thermal expansion coefficient and an auxiliary mold sized and adapted to be movable within said cast insert in a sliding, close-fitting relationship and having an auxiliary mold thermal expansion coefficient being greater than said cast insert thermal expansion coefficient;

charging said molten metal into said cavity thereby causing thermal expansion of said cast insert and said auxiliary mold whereby said auxiliary mold thermally expands within and against said cast insert from the sliding, close-fitting relationship and into an immobile, contacting relationship thereby pressing said cast insert in an expanding direction towards said molten metal; and forcibly cooling said auxiliary mold before and after said molten metal has completely solidified for contracting said auxiliary mold so that the immobile, contacting relationship between said auxiliary mold and said cast insert changes to the sliding, close-fitting relationship.

* * * * *